US007473142B2

(12) United States Patent
Chien et al.

(10) Patent No.: US 7,473,142 B2
(45) Date of Patent: Jan. 6, 2009

(54) AUDIO JACK WITH INCLINED COUPLING END FACE

(75) Inventors: Min-Ling Chien, Taipei (TW); Kai-Ray Cheng, Taipei (TW); Jian Cheng, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/600,922

(22) Filed: Nov. 17, 2006

(65) Prior Publication Data

US 2007/0254527 A1 Nov. 1, 2007

Related U.S. Application Data

(63) Continuation-in-part of application No. 11/411,791, filed on Apr. 27, 2006, now abandoned.

(51) Int. Cl.
*H01R 24/04* (2006.01)

(52) U.S. Cl. ..... 439/669; 439/607; 439/668; 439/541.5; 200/51.1

(58) Field of Classification Search ..... 439/668, 439/669, 607, 188, 541.5, 51.1; 200/51.09, 200/51.1, 51 R–51.13
See application file for complete search history.

(56) References Cited

U.S. PATENT DOCUMENTS 6,113,426 A * 9/2000 Lin ..... 439/607
6,524,138 B1 * 2/2003 Li et al. ..... 439/669
2005/0020140 A1 * 1/2005 Zhang et al. ..... 439/668

* cited by examiner

*Primary Examiner*—Renee Luebke
*Assistant Examiner*—Harshad C Patel
(74) *Attorney, Agent, or Firm*—Troxell Law Office, PLLC

(57) ABSTRACT

An audio jack includes an insulative housing (10) including a tapered, inclined rear end (13) having four sides wherein two horizontal sides are wider than the other two vertical sides, all four sides being inclined and coupled together; first, second, third, and fourth terminals (21, 22, 23, and 24) disposed in respective grooves (131, 132, 133, and 134) and each having an outer terminal (212, 222, 231, or 241) inclined and projected from the rear end (13); a plate (20) in the housing (10) served as a plug stopper; and a metal shell (30) enclosing the housing (10) and including inclined legs 32. The housing (10) further comprises two internal cavities (1311, 1321) positioning two of the first, second, third, and fourth terminals (21, 22, 23, and 24) respectively. The third and fourth terminals (23 and 24) are served as a switch upon insertion and removal of a plug (4).

3 Claims, 5 Drawing Sheets

AUDIO JACK WITH INCLINED COUPLING END FACE

This is a continuation-in-part of U.S. patent application Ser. No. 11/411,791, filed on Apr. 27, 2006 in the name of Min-Ling Chien et al. and entitled "AUDIO JACK WITH INCLINED COUPLING END FACE" is now abandoned.

BACKGROUND OF THE INVENTION

1. Field of Invention

The present invention relates to an electrical connector, and more particularly to an audio jack having an inclined coupling end face so as to effectively utilize a limited space of an electronic device.

2. Description of Related Art

Conventionally, an audio jack is responsible for providing an effective medium for signal transmission between two electronic communication devices. It is understood that an audio jack having an improved shape, a reduced space, or other advantageous benefits may contribute significantly to the advancement of the art.

SUMMARY OF THE INVENTION

It is therefore an object of the present invention to provide an audio jack having an inclined end face to be couple with a PCB so as to effectively utilize a limited space of an electronic device.

It is another object of the present invention to provide an audio jack comprising a couple of terminals having its bent inner terminals positioned in internal cavities of the audio jack housing so as to provide an elastic buffering and fastening effect when a plug is inserted into the audio jack.

To achieve the above and other objects, the present invention provides an audio jack comprising an insulative housing including four sides wherein two sides are wider than the other two sides, all four sides being inclined, and coupled together forming a tapered, inclined rear end; and first, second, third, and fourth grooves (131, 132, 133, and 134) open toward the rear end;

first, second, third, and fourth terminals disposed in the corresponding first, second, third, and fourth grooves respectively and having outer terminals inclined and projected from the rear end;

a plate mounted inside the housing served as a stopper for a plug inserted into the housing; and a metal shell enclosing the insulative housing and including a second inclined rear end and a plurality of inclined legs each extending from a respective side of the second rear end thereof;

wherein the housing further comprises two internal cavities positioning two of the first, second, third, and fourth terminals respectively, and wherein the third and fourth terminals are served as a switch upon the insertion and removal of the plug.

The above and other objects, features and advantages of the present invention will become apparent from the following detailed description taken with the accompanying drawings.

DETAILED DESCRIPTION OF THE INVENTION

Figure 1:
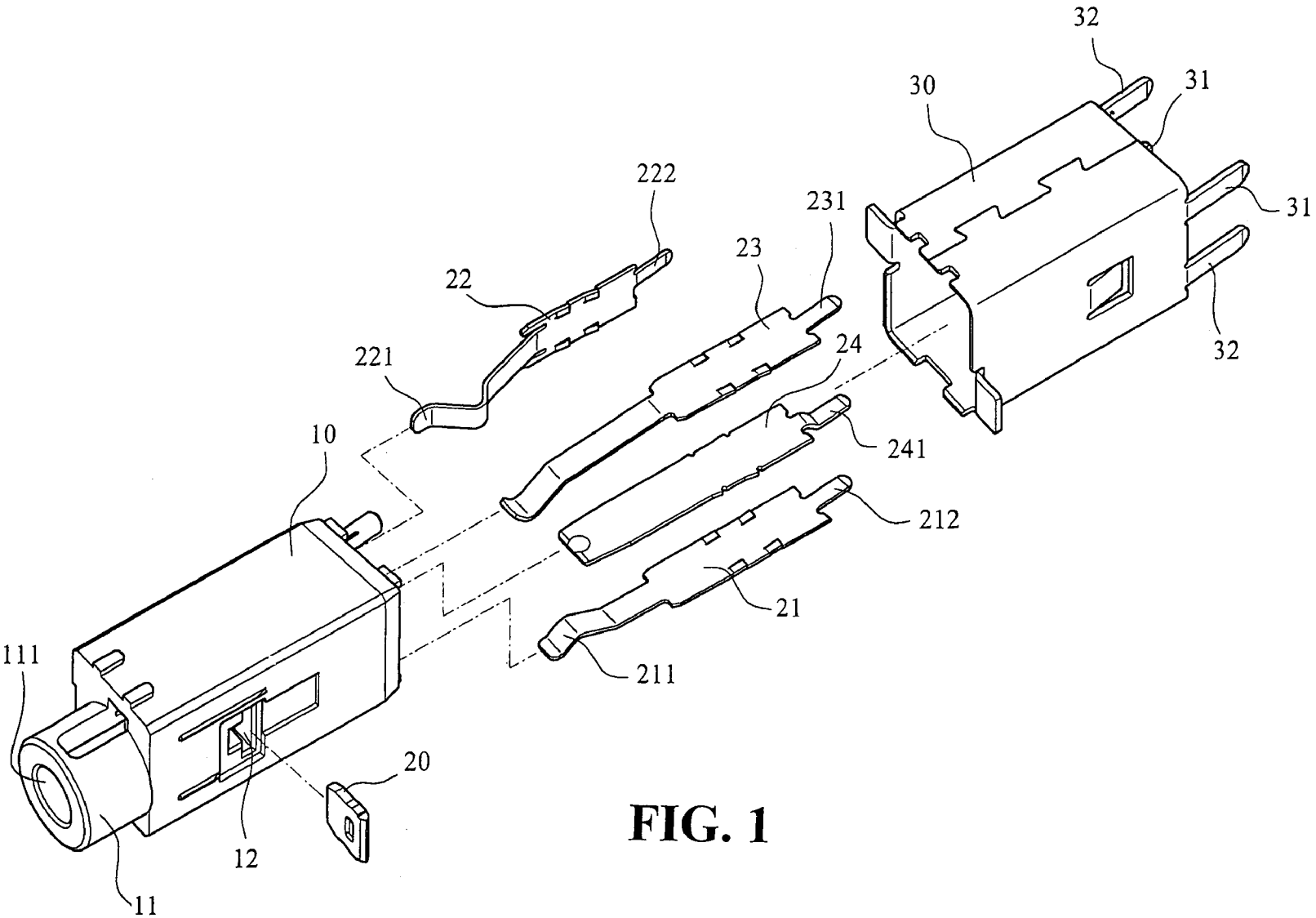
FIG. 1 is an exploded perspective view of a first preferred embodiment of audio jack according to the invention.
Figure 2:
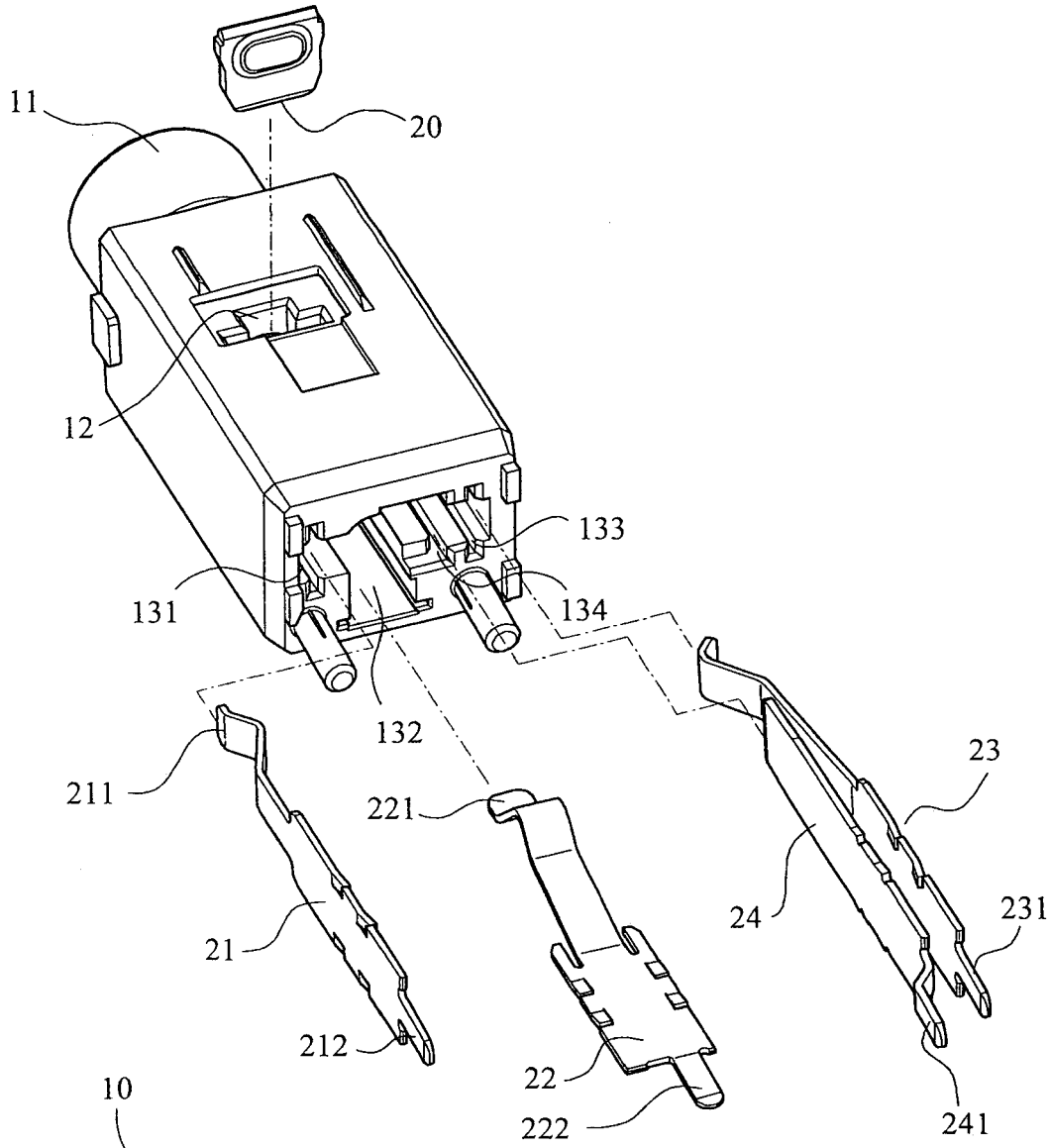
FIG. 2 is an exploded perspective view of the audio jack without the shell from an opposite angle.
Figure 2A:
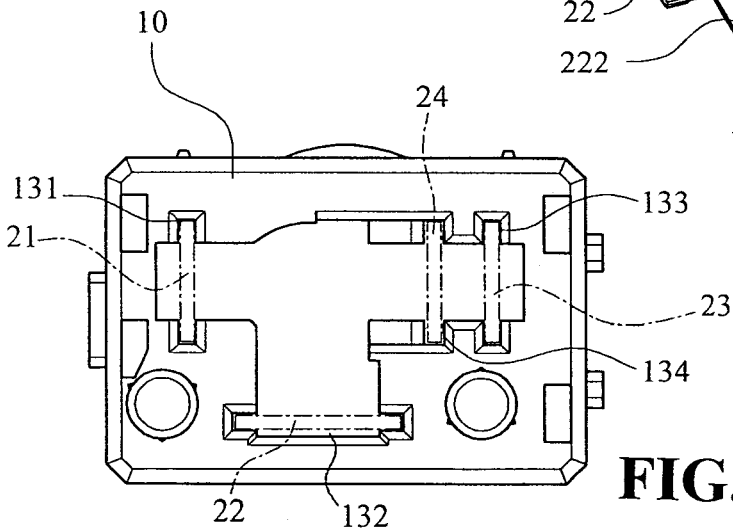
FIG. 2A is a rear view of FIG. 2.
Figure 3:
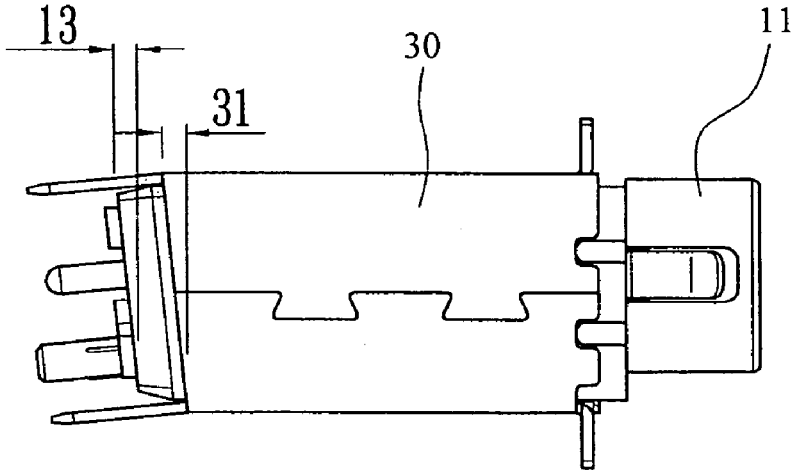
FIG. 3 is a side elevation view of the audio jack assembled with the shell.
Figure 4:
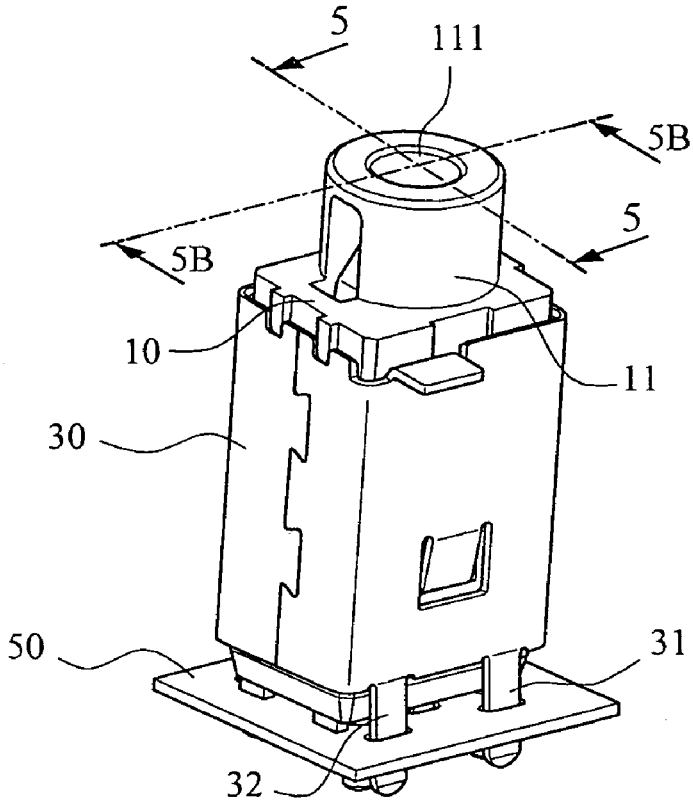
FIG. 4 is a perspective view of the audio jack of FIG. 3 mounted with a PCB.
Figure 5:
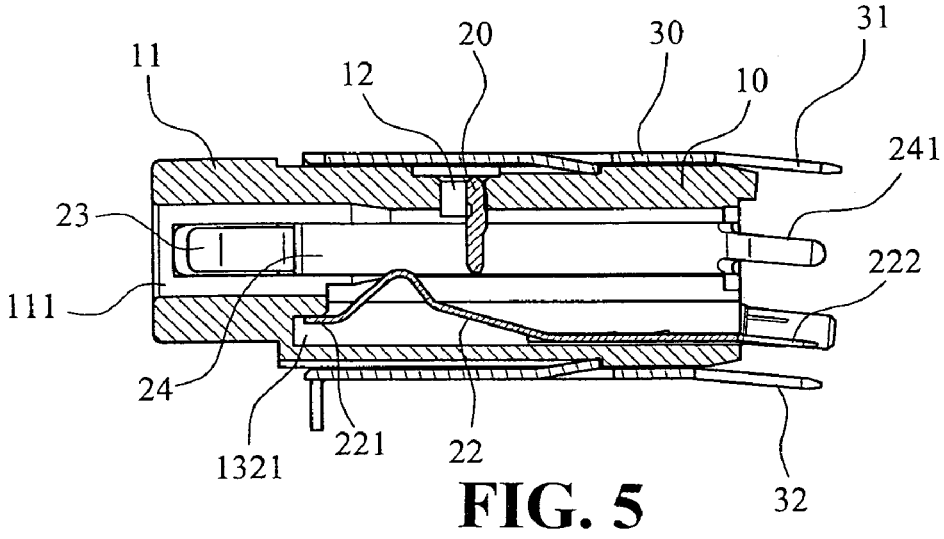
FIG. 5 is a sectional view taken along line 5-5 of FIG. 4.
Figure 5A:
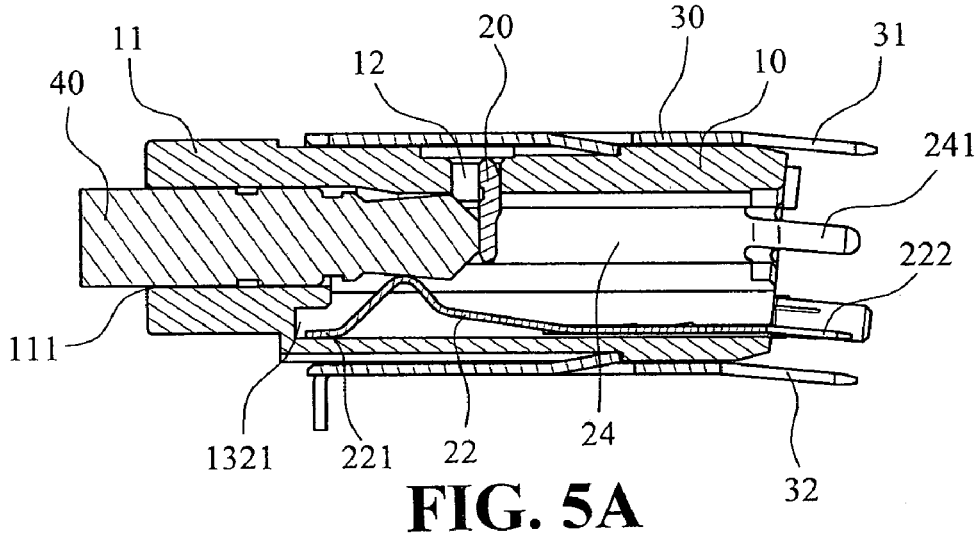
FIG. 5A is a view similar to FIG. 5 where an inserted plug is stopped by the plate.
Figure 5B:
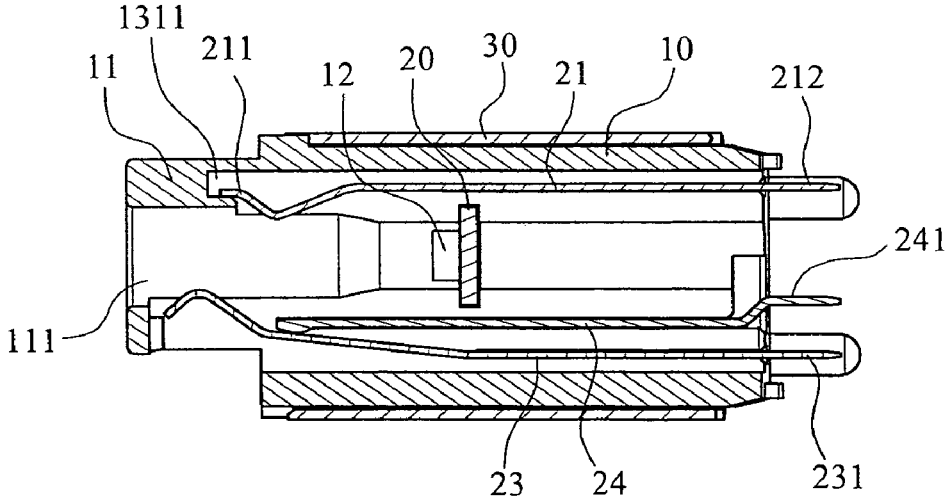
FIG. 5B is a sectional view taken along line 5B-5B of FIG. 4.
Figure 5C:
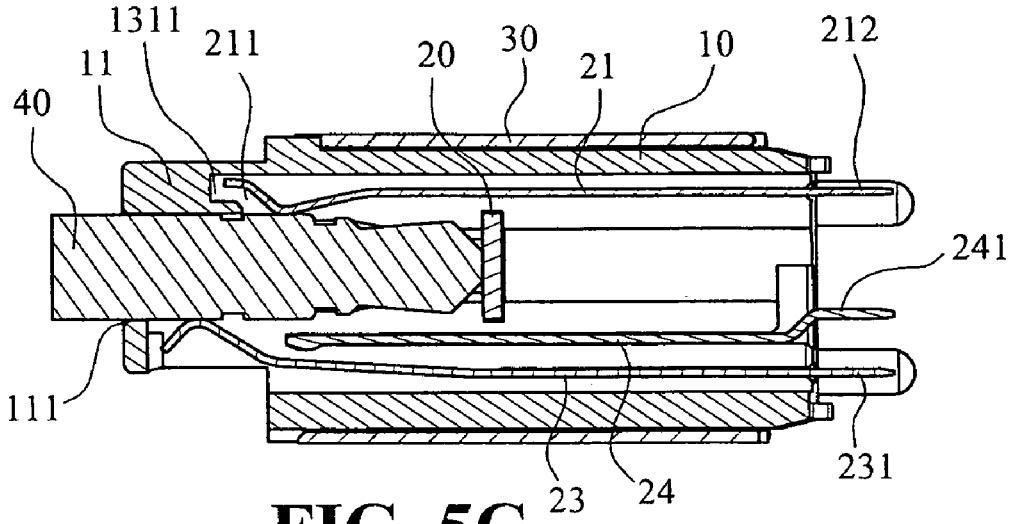
FIG. 5C is a view similar to FIG. 5B where the third and fourth terminals are disconnected due to the insertion of the plug.
Figure 6:
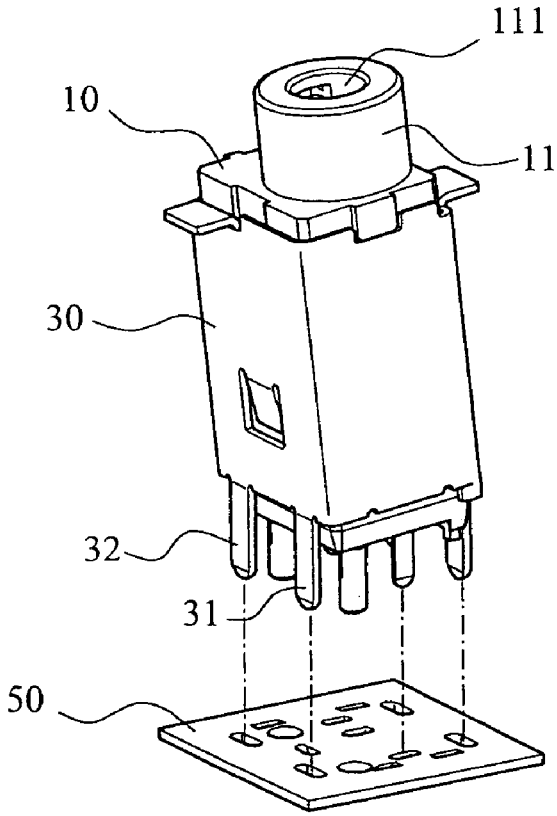
FIG. 6 is a perspective view of the audio jack to be mounted with the PCB but viewed from an angle different from that shown in FIG. 4.

Referring to FIGS. 1 to 6, an audio jack in accordance with the invention comprises an elongated parallelepiped insulative housing 10 including a front projected cylinder 11 having an axial channel 111 in communication with an internal space of the housing 10, first, second, third, and fourth grooves 131, 132, 133, and 134 in the housing 10, and a lateral slot 12 which has its both ends terminated at an outer surface of the housing 10 and the internal space thereof. A plate 20 is adapted to mount inside the slot 12 served as a stop of an inserted plug 40 (see FIG. 5A). The housing 10 has a short tapered, inclined rear end 13. Each of the first, second, third, and fourth grooves 131, 132, 133, and 134 has an open end terminated at the rear end 13, as shown in FIGS. 2 and 2A. A cavity 1311 is formed at a closed end of each of the first and second grooves 131 and 132. The short tapered, inclined rear end 13 is constructed as one has four sides in which two sides are wider, the two other sides are shorter, and the all four sides are inclined and are coupled together (see FIG. 2). The audio jack further comprises first, second, third, and fourth elongated, thin plate shaped terminals 21, 22, 23, and 24 in which each of the first and the second terminals 21 and 22 has its bent inner terminal 211 or 221 positioned in the cavity 1311 or 1321. In detail, the first terminal 21 is inserted into the first groove 131 from the rear end 13 until its bent inner terminal 211 positioned in the cavity 1311 of the first groove 131. Similarly, the second terminal 22 is inserted into the second groove 132 from the rear end 13 until its bent inner terminal 221 positioned in the cavity 1321 of the second groove 132. The bent inner terminals 211 and 221 of the first and second terminals 21 and 22 positioned in the cavities 1311 and 1321 are adapted to provide an elastic buffering and fastening effect when the plug 40 is inserted into the audio jack as shown in FIGS. 5A and 5C. The third and the fourth terminals 23 and 24 are served as a switch and are mounted in the third and the fourth grooves 133 and 134 respectively. As shown in FIGS. 5B and 5C, the third and the fourth terminals 23 and 24 are disconnected when the plug 40 is inserted into the jack from the channel 111. Thus, a user of the jack is aware of the insertion of the plug 40 by observing an electrical disconnection of the third and the fourth terminals 23 and 24. This is one of the characteristics of the invention. Outer terminals 212, 222, 231, and 241 of the first, second, third, and fourth terminals 21, 22, 23, and 24 are slightly inclined and are projected from the rear end 13 so as to electrically connect to a PCB (printed circuit board) 50 as shown in either FIG. 4 or FIG. 6.

The audio jack further comprises a metal shell 30 formed by punching and bending. The shell 30 has a rectangular section and an inclined rear end 31. The shell 30 is adapted to enclose the audio jack and comprises four slightly inclined legs 32 extended from sides of the rear end 31. The slightly inclined legs 32 are adapted to assemble with the PCB 50, as shown in either FIG. 4 or FIG. 6. The inclined rear end 31 is constructed substantially the same as the rear end 13. That is, the rear end 31 has four sides in which two sides are wider, the other two sides are shorter, and the all four sides are inclined and are coupled together (see FIG. 3).

The PCB 50 is flat. Thus, the audio jack is not perpendicular to the PCB 50 when the slightly inclined legs 32 are inserted into the PCB 50 or fastening. That is, the audio jack is inclined in its fastened state.

While the invention herein disclosed has been described by means of specific embodiments, numerous modifications and variations could be made thereto by those skilled in the art without departing from the scope and spirit of the invention set forth in the claims.

What is claimed is:

1. An audio jack comprising:

an insulative housing (10) including four sides of a first, second, third, and fourth sides wherein the second and fourth sides are wider than the first and third side, all four sides being inclined, and coupled together forming a tapered, inclined rear end (13); and a first, second, third, and fourth grooves (131, 132, 133, and 134) open toward the rear end (13) wherein the first groove (131) is disposed in the first side, the second groove (132) is disposed in the second side, the third and fourth grooves are disposed in the third side, and a lateral slot (12) terminated at an outer surface of the fourth side of the housing (10) and an internal space thereof;

first, second, third, and fourth terminals (21, 22, 23, and 24) disposed in the corresponding first, second, third, and fourth grooves (131, 132, 133, and 134) respectively and having outer terminals (212, 222, 231, 241) inclined and projected from the rear end (13);

a plate (20) mounted inside the housing (10), by being inserted from the slot (12) into the housing (10), serves as a stopper for a plug (40) inserted into the housing (10); and a metal shell (30) enclosing the insulative housing (10) and including a second inclined rear end (31) and a plurality of inclined legs (32) each extending from a respective side of the second rear end (31) thereof;

wherein the housing (10) further comprises two internal cavities (1311, 1321) positioning two of the first, second, third, and fourth terminals (21, 22, 23, and 24) respectively, and wherein the third and fourth terminals (23 and 24) serve as a switch upon the insertion and removal of the plug (40).

2. The audio jack of claim 1, wherein one of the cavities (1311) is formed at a closed end of the first groove (131) for positioning a bent end terminal (211) of the first terminal (21) therein.

3. The audio jack of claim 1, wherein the other one of the cavities (1321) is formed at a closed end of the second groove (132) for positioning a bent end terminal (221) of the second terminal (22) therein.

* * * * *